US005853088A

United States Patent [19]

Saulas et al.

[11] Patent Number: 5,853,088

[45] Date of Patent: Dec. 29, 1998

[54] CARTON

[75] Inventors: Alain Saulas; Jean-Yves Daniel; Jean-Michel Auclair, all of Chateuroux, France

[73] Assignee: The Mead Corporation, Dayton, Ohio

[21] Appl. No.: 849,601

[22] Filed: Jun. 2, 1997

[30] Foreign Application Priority Data

| | | | |
|---|---|---|---|
| Dec. 2, 1994 | [GB] | United Kingdom | 9424358 |
| Jul. 26, 1995 | [GB] | United Kingdom | 9515358 |

[51] Int. Cl.[6] ..... B65D 75/00

[52] U.S. Cl. ..... 206/427; 206/814

[58] Field of Search ..... 206/427, 428, 206/434, 814; 229/87.04, 89

[56] References Cited

U.S. PATENT DOCUMENTS

| | | | |
|---|---|---|---|
| 4,096,985 | 6/1978 | Wood | 206/427 X |
| 4,742,917 | 5/1988 | Bornwasser et al. | 229/120.011 |
| 4,817,797 | 4/1989 | Hamelin | 206/428 |
| 4,848,651 | 7/1989 | Hartness | 229/125.33 |
| 5,163,607 | 11/1992 | Kuhn et al. | 206/427 X |

FOREIGN PATENT DOCUMENTS

| | | |
|---|---|---|
| 0 244 047 | 11/1987 | European Pat. Off. . |
| 0 341 089 | 11/1989 | European Pat. Off. . |
| 0 428 397 | 5/1991 | European Pat. Off. . |
| 2 596 972 | 10/1987 | France . |
| 2 600 307 | 12/1987 | France . |
| 2 659 624 | 9/1991 | France . |
| 2 684 078 | 5/1993 | France . |
| 30 21 772 | 1/1981 | Germany . |
| 88 03 454.2 | 7/1988 | Germany . |
| 2 206 101 | 12/1988 | United Kingdom . |
| 2 209 515 | 5/1989 | United Kingdom . |
| 2 259 907 | 3/1993 | United Kingdom . |

*Primary Examiner*—Jacob K. Ackun
*Attorney, Agent, or Firm*—Thomas A. Boshinski

[57] ABSTRACT

A carton for packaging primary containers arranged in at least three lateral rows in which the center of said rows has fewer containers than adjacent rows. The carton comprises a pair of superposed tray structures (70) which are connected together by a wrapper (10) having a handle structure (52). The trays each have a retaining keel (94) extending inwardly of the tray for retaining the center row of containers in an inwardly offset condition with respect to the adjacent rows of containers.

12 Claims, 10 Drawing Sheets

112
122a
110
114
124a
128
124b
162
132
160a
136
144
152
116
150
160b
124d
124c
164
118
122b
148
120

312
314a
322a
314b
322c
344
310
316
352
350
346
322d
W2
318b
322b
W1
318a
320

CARTON

The invention relates to cartons for carrying a plurality of articles such as bottles or cans for example. In particular, one aspect of the invention relates to a carton comprising two or more tiers of articles stacked one on top of the other, and another aspect relates to a carton having a carrying handle.

It is known from U.S. Pat. No. 4,848,651 to provide a fully enclosed carton comprising an outer wrapper and two trays of articles. In U.S. Pat. No. 4,848,651, Hartness teaches how a fully enclosed carton can be formed from two trays of cans stacked one on top of the other and a wrapper comprising a central panel and two sides and two end panels. The wrapper is placed against the tops of the cans in the upper tray and the side and end panels of the wrapper are folded downwardly against the sides of both upper and lower trays of cans. The cover panel is detachably secured to the lowermost tray along lines of adhesive material.

EP 0341089 discloses a carton for packaging a plurality of articles which comprises a strap handle. The strap is struck from the top panel and upper end panels which form a sloping wall, or bevelled strip, which contours the shoulders of bottles contained within the carton. The strap is hingably connected to the carton end walls and in use extends into the carton adjacent the walls thereby to enable the strap to be pulled upwardly away from the top panel. The carton shown is octagonal in plan elevation and is adapted to retain six rows of bottles in a four-five-four-four-five-four arrangement. This arrangement of the articles itself provides spaces on the inside of the carton adjacent the region of the end walls to which the handle strap is hinged.

DE-U-8803454 discloses a tray having at least two opposed side walls of the tray with integrated pads which are formed from two walls with a distance between them. The walls are coordinated to be approximately parallel by means of connecting pieces and base tabs. The pads have indentations matched to the goods to be received which can be slipped onto the base tabs. In this arrangement, other articles are supported by the pads.

FR-A-2596972 discloses a tray for supporting a plurality of articles, each article being positioned in a corner of the tray. It comprises a base and two opposed faces, each face including a cut out part struck partially from the base. The cut out part is intended when placed in its operative position to constitute a gripping device for wedging each article in a corner portion of the tray.

One aspect of the invention provides a carton for packaging a plurality of primary containers arranged in at least three lateral rows, a centre of said rows having fewer containers than adjacent ones of said rows, comprising:

a support panel upon which said containers are to be placed;

a top panel;

first and second side walls connected to said top panel;

means for retaining said support panel in a position with respect to said side panels;

means between said support panel and at least one of said side walls and extending inwardly of said package for retaining said centre row of said containers in an inwardly offset condition with respect to said adjacent rows of said containers.

According to a feature of this aspect of the invention, a handle may be formed at least partially from said top panel and said first and second side panels and which, during use, protrudes partially into said carton adjacent to said centre row.

According to another feature of this aspect of the invention, a bottom panel may be connected between said first and second side walls upon which a second layer of primary containers are placed, said support panel being spaced from said bottom panel by a distance substantially equal to the height of the primary containers.

According to yet another feature of this aspect of the invention, the said support panel may form a portion of a tray for retaining the primary containers placed thereon, said means for retaining said support panel in position including means for fixing said tray with respect to said top panel and first and second side walls. Preferably, the fixing means includes retention gussets connected between said top panel and said first and second side walls for retention of said containers placed within said tray, whereby said tray is fixed in relative position.

According to a further feature of this aspect of the invention, said centre row retaining means may include a first panel hingably connected to said support panel and a second panel hingably connected between said first panel and a side wall of said tray, said first and second panels being disposed for positioning between endmost containers of said centre row and said adjacent rows.

According to a still further feature of this aspect of the invention, said support panel may be connected to said first panel and side walls and forms a bottom wall for said carton.

Another aspect of the invention provides a carton accommodating a plurality of primary containers arranged in an least three lateral rows, a centre of said rows having fewer containers than adjacent ones of said rows, comprising:

a support panel upon which said containers are placed;

a top panel;

first and second side walls connected to said top panel;

means for retaining said support panel in a position with respect to said side panels;

means between said support panel and at least one of said side walls and extending inwardly of said package for retaining said centre row of said containers in an inwardly offset condition with respect to said adjacent rows of said containers and a handle formed at least partially from said top panel and said first and second side panels and which, during use, protrudes partially into said carton adjacent to said centre row.

Another aspect of the invention provides a tray for carrying a plurality of articles comprising a base panel and upwardly projecting side panels, the tray being adapted to accomodate at least three adjacent rows of articles wherein the central row has one less article than the outer rows and wherein two adjacent rows are longitudinally displaced from one another to provide a closely packed formation, the tray comprising means which projects inwardly into the tray to prevent movement of articles within the tray characterised in that said inwardly projecting means is provided at each end of said central row to restrict movement of articles in said central row, said inwardly projecting means comprising a lateral panel which is hinged to and projects inwardly from a tray side wall panel and a lower panel which is hinged to and projects upwardly from the base panel, said lower and lateral panels being hingably connected to one another.

Yet another aspect of the invention provides a carton blank for forming a tray for carrying a plurality of articles which blank comprises a base panel, side panels hinged thereto, the tray when formed being adapted to accommodate at least three adjacent rows of articles wherein the central row has one less article than the outer rows and wherein two adjacent rows are longitudinally displaced from one another to provide a closely packed formation, the blank further comprising means which are adapted to project inwardly into the tray to prevent movement of articles within the tray when in use characterised in that said means for projecting inwardly comprises a lateral panel which is hinged to and struck from a tray side wall panel and a lower panel which is hinged to and struck from the base panel said lower and lateral panels being hingably connected to one another.

According to a feature of this aspect of the invention, said base panel may comprise a first panel part and a second panel part hinged together by a series of panels adapted to provide a top for the tray and a pair of opposed side walls each of which is hinged to said top and to said base and wherein each of said side walls incorporates one of said lateral panels.

According to yet another aspect of the invention, there is provided a carton blank wrapper for coupling together a pair of trays of the type as defined above, in which the trays are disposed one atop another to create a stack, said wrapper comprising a top panel for location upon the top of the articles in the uppermost tray, a pair of side wall panels hinged to opposed edges of said top panel and flanking opposed sides of said stack and a base panel hinged to each of said side wall panels and secured to lower portions of the lowermost tray and wherein said wrapper side wall panels and/or top panel includes restraining means for co-operation with articles of the uppermost tray in said stack to inhibit movement of the uppermost tray relative to the next adjacent tray.

Embodiments of the invention will now be described, by way of example only, with reference to the accompanying drawings, in which.

Figure 1:
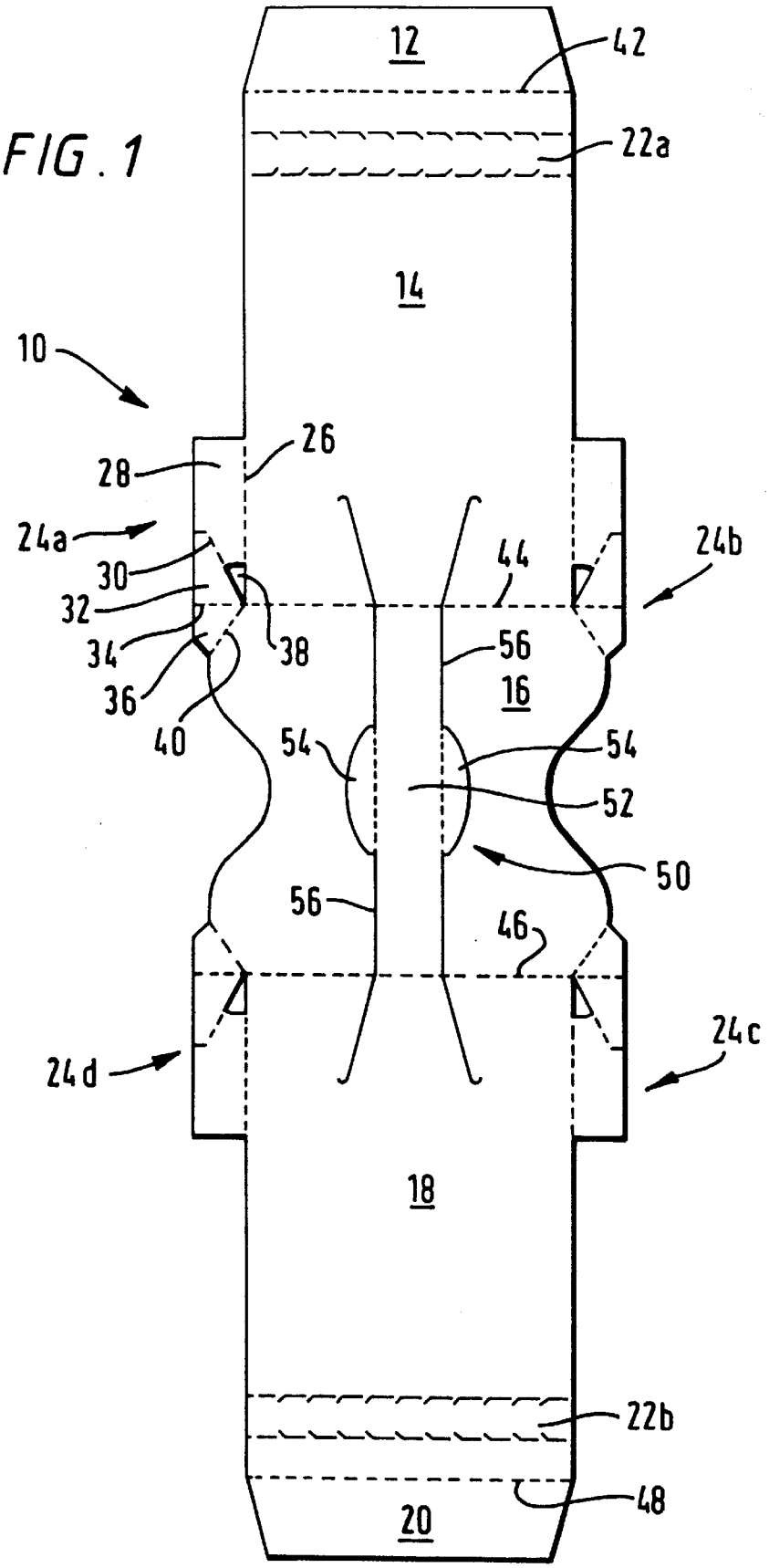
FIG. 1 is a plan view of a blank for forming the wrapper part of a carton according to a first embodiment of the invention.

Referring to FIGS. 1 to 5, there is shown an embodiment of a carton and its various components according to the present invention. In FIG. 1, a wrapper 10 is shown which is formed from paperboard and comprises an end panel 12 hingably connected to a side panel 14 which in turn is hingably connected to a top panel 16. Top panel 16 in turn is hingably connected to a second side panel 18 which is hingably connected to end panel 20. The panels just described are hingably connected in series respectively by fold lines 42, 44, 46 and 48. Side panels 14 and 18 preferably comprise tear strips 22*a* and 22*b* respectively. A carrying handle 50 is provided comprising a strap 52 having lateral finger tabs 54 hingably connected thereto. The handle 50 is struck from side panels 14 and 18 and top panel 16 by cut lines 56 which extend across hinge lines 44 and 46.

In this example, gussets 24 are provided which extend between each side edge of the side panels 14 and 18 and the upper panel 16. Thus, four gussets 24*a*, 24*b*, 24*c* and 24*d* are provided. Referring to gusset 24*a* by way of example, each gusset comprises a perforate fold line 26 which connects a folding panel 28 to a side panel. The folding panel 28 can be hingably attached to an intermediate gusset panel 32 by a perforated fold line 30. Aperture 38 is provided between intermediate gusset panel 32 and the side panel thereby to facilitate folding of the gusset 24. The intermediate gusset panel 32 is connected to a upper gusset panel 36 by fold line 34. Upper gusset panel 36 is hingably connected to upper panel 16 along a told line 40.

Figure 2:
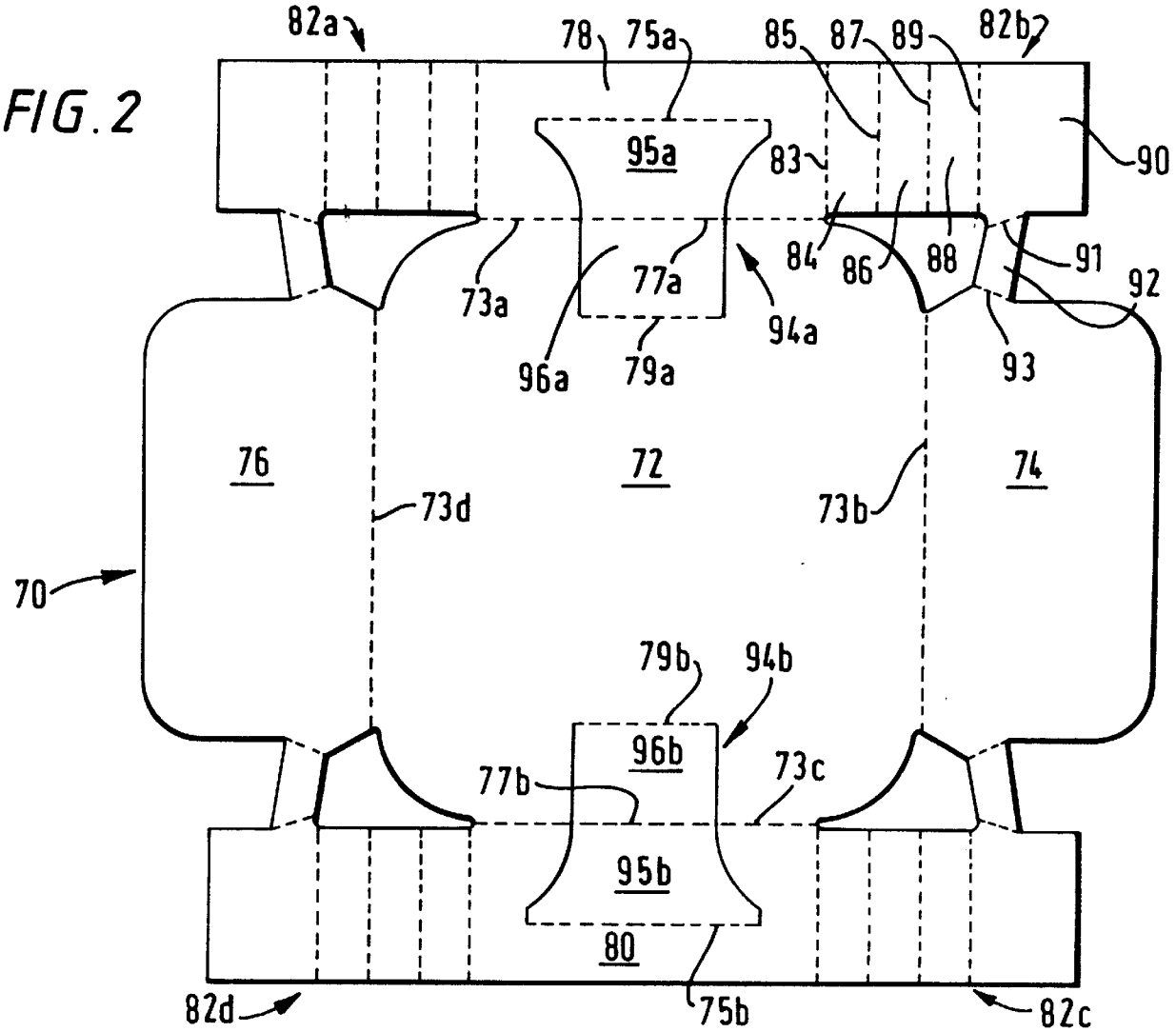
FIG. 2 is a plan view of a blank for forming a tray part of the carton according to the invention.

A blank for forming individual trays for a carton according to the invention is shown in FIG. 2. Tray 70 comprises a base panel 72 which is hingably connected to four side panels 74, 76, 78 and 80 along fold line 73*b*, 73*d*, 73*a* and 73*c* respectively. The side panels 78 and 80 comprise corner arrangements 82 and in this example they are provided at each end of panels 78 and 80 thereby to provide a corner arrangement 82*a*, 82*b*, 82*c* and 82*d* for each corner of tray 70. By way of example, a corner arrangement 82*b* comprises a series of panel portions 84, 86, 88 and 90 which are hingably connected in series to each other by fold lines 85, 87 and 89, and to the side panel by fold line 83 as shown in FIG. 2. The endmost panel portion 90 is hingably connected by a gusset panel 92 by fold lines 91 and 93 to a lateral edge of a side panel, such as 74 in the case of arrangement 82*b*.

The tray described here is designed to accommodate eight cans in a three-two-three closely packed or nested arrangement wherein adjacent rows are displaced half a can apart longitudinally along the direction of the rows. Thus individual articles such as beverage cans abut six neighbours, two in each adjacent row and two in the same row. Of course, a tray can be provided for any number of articles or rows of articles. The trays also comprise one or more keels such as keels 94*a* and 94*b* shown in FIG. 2. Each keel is stuck partially from the base panel 72 and partially from a side panel 78 or 80 and comprises an upper panel 95*a* or 95*b* hingably connected to side panels 78 or 80 by fold line 75*a* or 75*b* respectively. The upper panel 95*a* or 95*b* is hingably connected to a side panel 96*a* or 96*b* respectively at fold line 77 which is coincident with fold line 73*a* or 73*c* respectively. In turn, side panel 96*a* or 96*b* is hingably connected to the base panel 72 by a fold line 79*a* or 79*b* respectively. The keel conveniently abuts three adjacent articles to maintain the ordered arrangement when the tray is formed.

The keels 94*a* and 94*b* are put into a set-up condition automatically when the side panels 78 and 80 are erected. To set-up and load the tray the side panels 78 and 80 are folded upwardly about fold line 73*a* and 73*c* respectively thus automatically setting up both keels 94*a* and 94*b*. It is then possible to load the partially formed tray by passing articles over the side panels 74 and 76 prior to closing those sides of the tray. The keels 94*a* and 94*b* force the articles into proper position whereby they assume the three-two-two-three arrangement. To close the open sides, side panels 74 and 76 are initially lowered by rotating about fold lines 73*b* and 73*d* respectively thereby causing gusset panels 92 to fold the associated corner arrangement 82 inwardly. This motion is continued so that each of the panels in each of the corner arrangements 82 is rotated slightly thereby to cause a substantially curved corner feature. The side panels 74 and 76 can then be raised about respective fold lines 73*b* and 73*d* and attached to adjacent corner arrangements, for example by gluing between the inside surface of the side panel and the outside surface of end panel 90 of a corner arrangement 82.

Alternately, the trays could be loaded after completion, for example, by lowering articles into the tray or lowering the tray onto articles.

Figure 3:
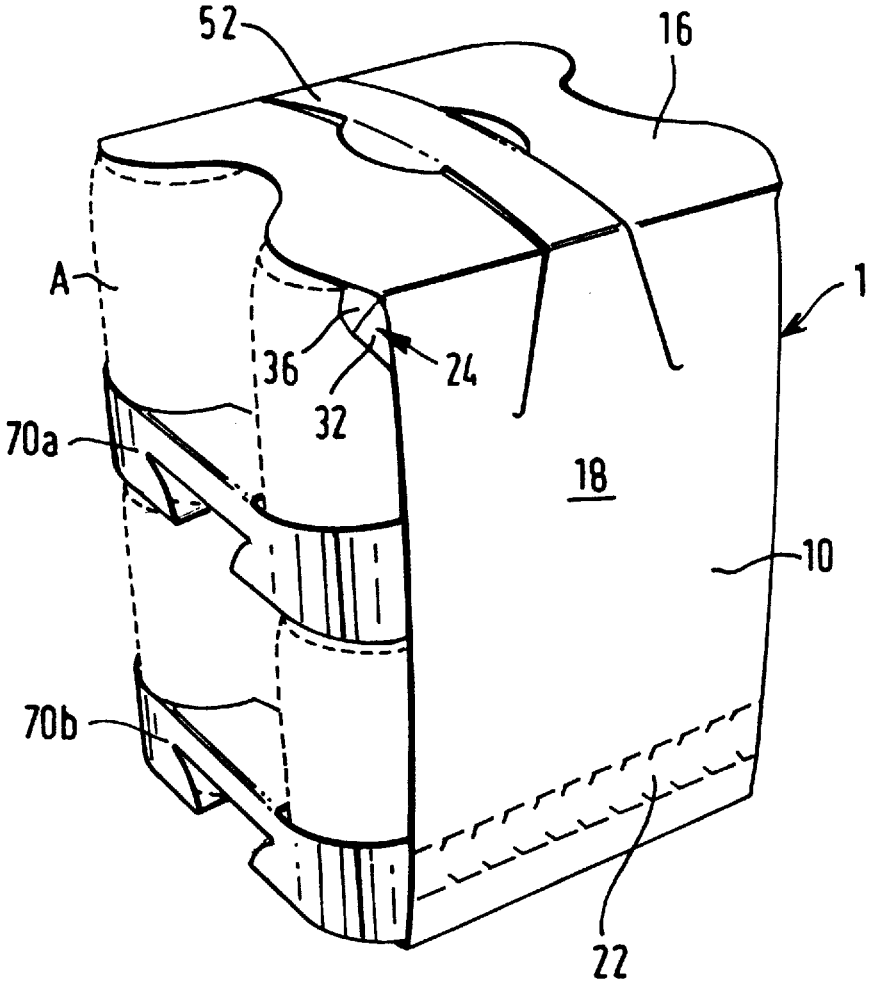
FIGS. 3 and 4 show perspective views of a first embodiment of a carton according to the invention comprising the wrapper shown in FIG. 1 and tray shown in FIG. 2.

A carton 1 formed from wrapper 10 and two trays 70*a* and 70*b* is shown in FIG. 3. To form the completed carton 1 a first tray 70*a* is placed on top of a lower tray 70*b* to form a two-tiered arrangement. A wrapper 10 can then be folded around the arrangement and attached thereto for example by gluing end panels 12 and 20 to the underside of the base panel 72 of the lowermost tray 70*b*.

In order to retain the uppermost tray 70*a* without attaching it by gluing for example to the wrapper, gussets 24 are provided to engage the uppermost shoulders and tops of the outermost articles A in the uppermost tray. The gussets might be formed by lowering top panel 16 onto the tops of the articles A in the uppermost tray 70*a*, then folding the folding panel 28 inwardly to abut the inside of the associated side panel 14 or 18 of wrapper 10. This causes the gusset panels 32 and 36 to fold into a cupping configuration which can accommodate part of the top of an article. This can be seen in FIG. 3 for example. This motion also initiates partial downward bending of the side panels about fold lines 44 and 46 which downward motion can be continued to wrap the two trays as described earlier. Thus, a two-tiered arrangement can easily be formed with minimal attachment of a wrapper to the trays whilst retaining individual tiers or layers, of articles.

Figure 4:
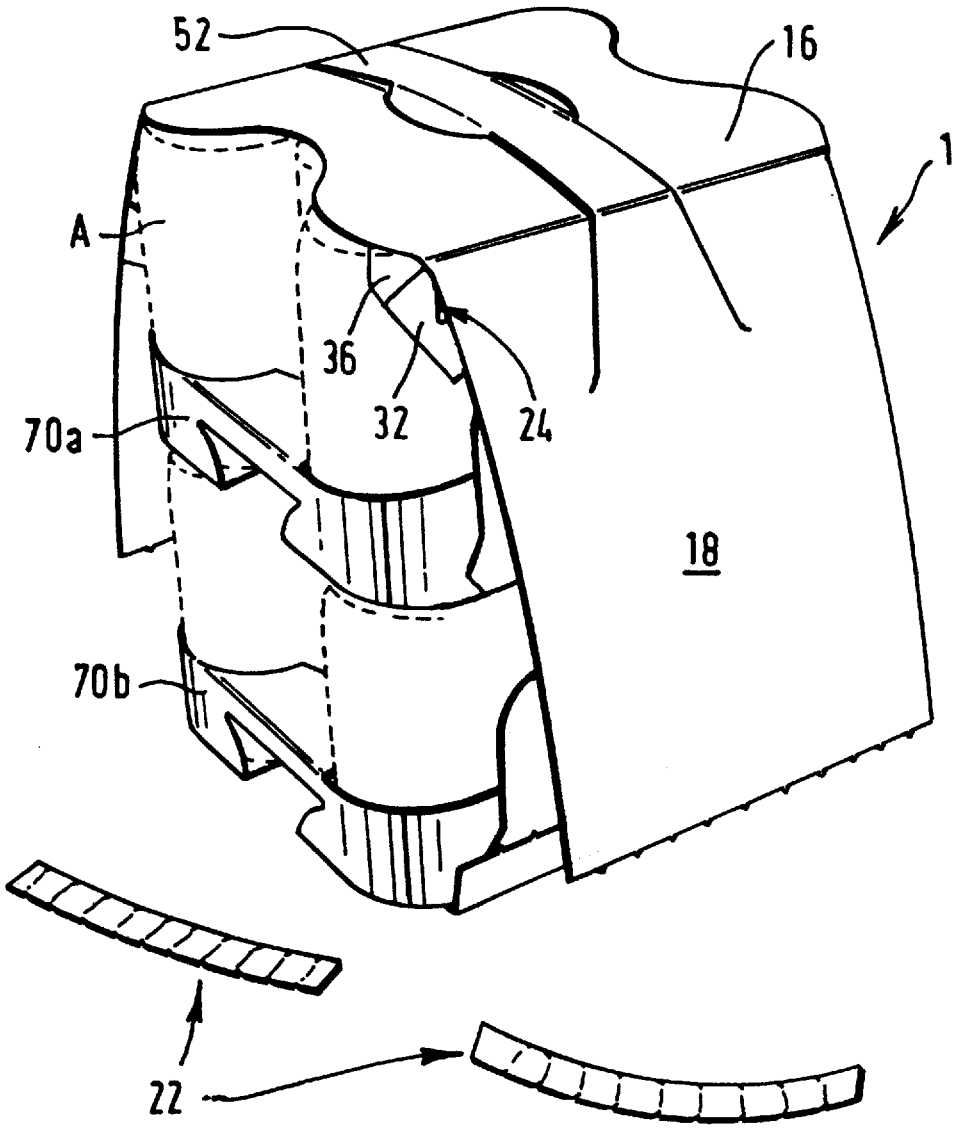

In order to open the carton, one or both of the tear strips 22 can be removed thus separating the wrapper from the trays as shown in FIG. 4. The two trays 70 can then be separated from one another. In this example, the tray 70 comprises keels 94 and are therefore adapted to retain eight articles in a nested three, two, three arrangement which is closely packed and the keels abut the sides of adjacent cans as shown in FIG. 3.

Of course, any number of trays can be retained in a carton of this type and one simply needs to adjust the length of each of the side panels 14 and 18 to accommodate different numbers of trays. Also, retaining features in place of or as well as gussets 24 might be provided for any one or more of the trays or tiers in a single tier or multi-tiered carton. The other means for attaching a wrapper to a tray might be gluing or mechanical locking means such as one or more co-operating locking tabs and apertures for example. The locking tab might be struck from one portion such as the wrapper and an aperture provided in another portion of the carton such as a tray side wall. It is envisaged that a tray of the type described with reference to FIG. 2 may be used without being tiered or without the described wrapper either with or without some form of top cover. Moreover, the wrapper may be used in a single tray arrangement and/or with other forms of trays.

Figure 5:
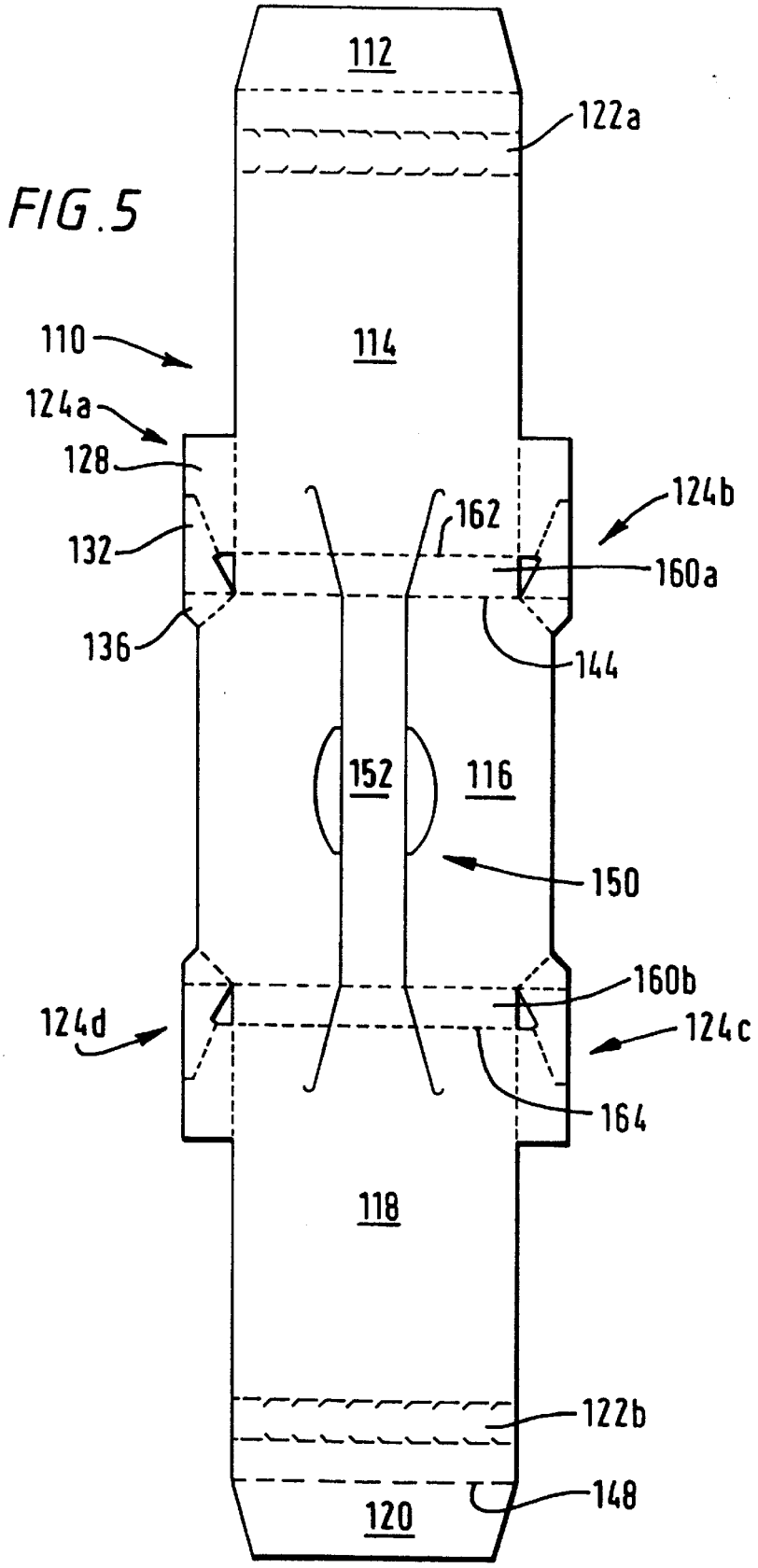
FIG. 5 is a plan view of a blank for forming a second wrapper for a carton according to the invention.
Figure 6:
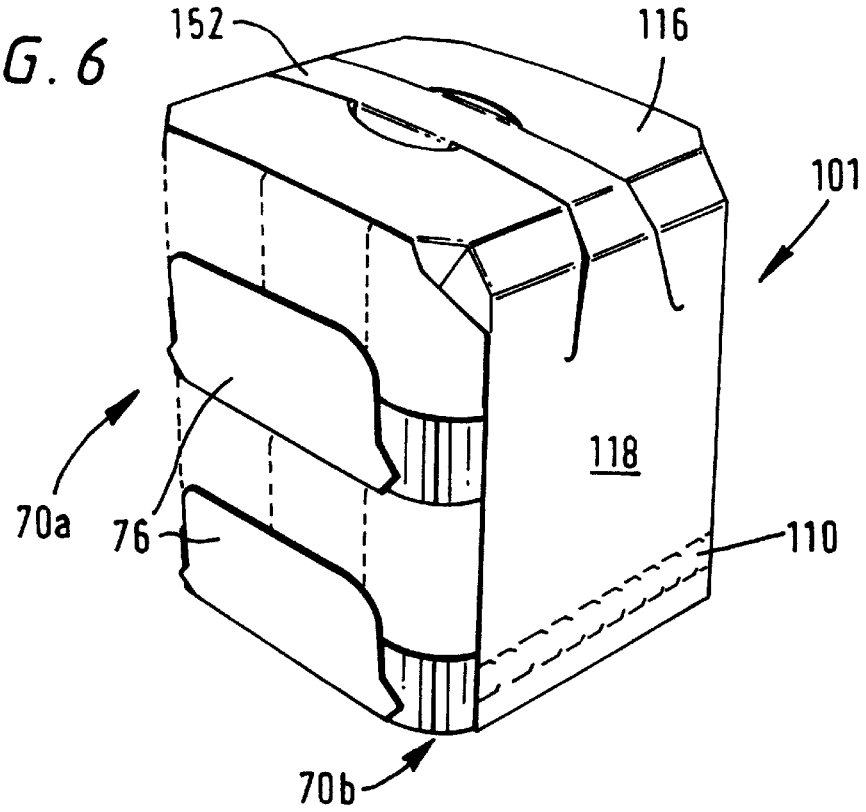
FIGS. 6, 7 and 8 are perspective views of a second embodiment of the carton according to the invention comprising the wrapper shown in FIG. 5 and tray shown in FIG. 2.

A second embodiment of a carton 101 according to the invention is shown in FIGS. 5 to 8. In this example, features which are similar to those shown in FIGS. 1 to 4 are labelled with the same two digit reference number prefixed with the digit 1. Accordingly, a wrapper blank 110 comprises end panels 112 and 120, side panels 114 and 118 and a top panel 116. In this example, a shoulder panel 160*a* and 160*b* is provided in the uppermost portion of each of the side panels 114 and 118 respectively to contour the shoulders of the articles A as shown in FIG. 6.

Trays such as those shown in FIG. 2 can be used to form carton 101 shown in FIG. 6 and in order to do so, the formed trays are stacked on top of each other as described earlier except that in this example, the orientation of the trays with respect to the wrapper 110 is different. Here, the trays are arranged so that side panel 76 and 74 are exposed in the carton 101 and wrapper 110 abuts the side panels 78 and 80 of the tray.

The wrapper and gussets 124 can be formed in the same manner as described earlier. However, an advantage of this arrangement is a handle which may be more easily manipulated by the consumer. It can be seen for example from FIG. 8 that a space exists above the keels 94, the space being located adjacent the lower portions of handle 150 struck from side panels 114 and 118 when the wrapper 110 is positioned about the trays. Upward lifting of handle 150 for carrying the package will draw these lower portions inward of the carton side panels, thereby increasing the distance above upper panel 116 which handle 150 may be moved. Additionally, this reduces the stresses in the handle in the regions adjacent the carton corners. Beneficially, this feature also provides greater stability when carrying the carton since it acts to retain the upper tray 70*a* by keying in between the outermost rows of three articles. Therefore, a combined retaining action is achieved through handle strap 152 and the gussets 124 which co-operate to retain the uppermost tray.

Figure 7:
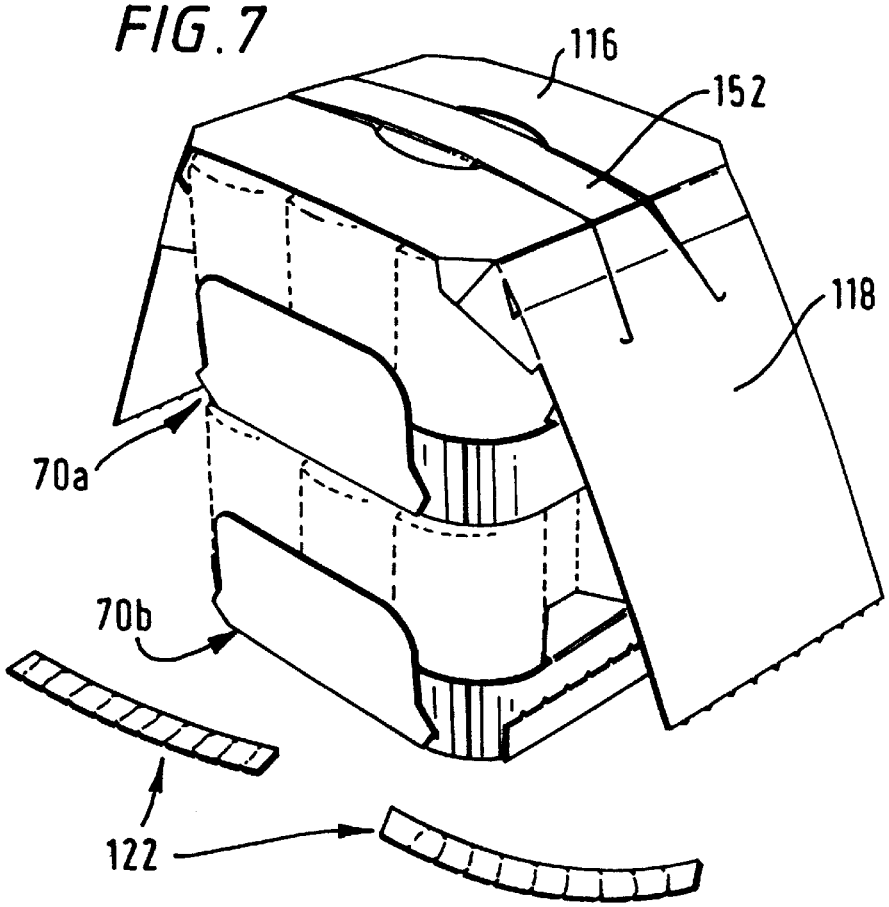
Figure 8:
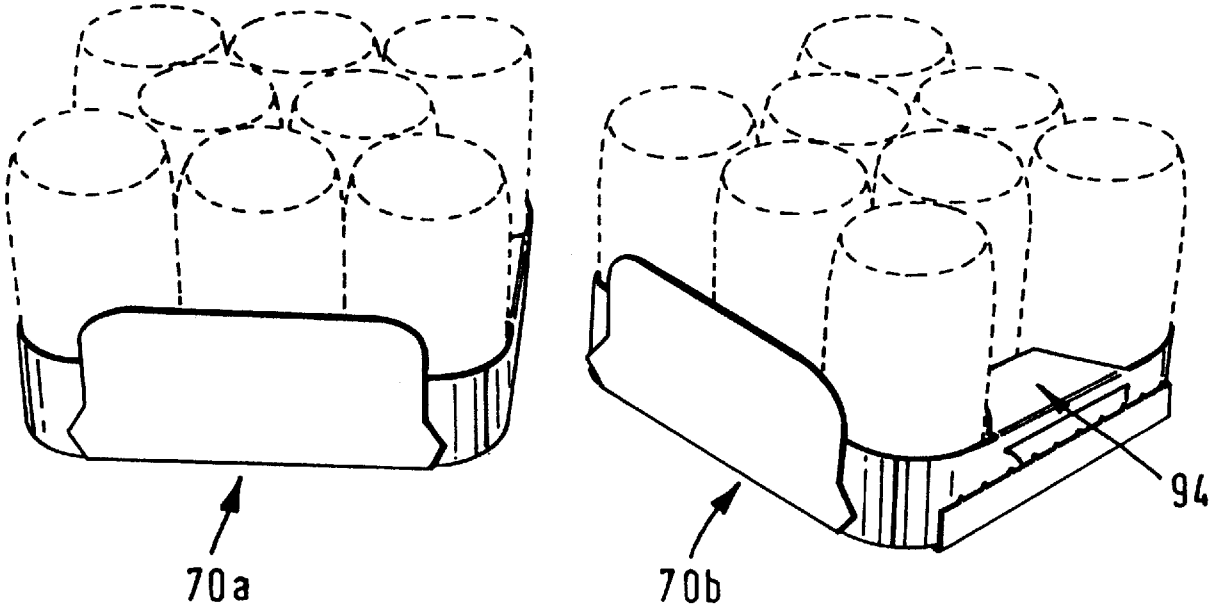

In this example, the trays can again be separated from wrapper 110 by removing tear strip features 122 as shown in FIG. 7 thereby to provide access to the trays as shown in FIG. 8. Of course, the orientation of the trays with respect to the wrapper can be either way round for either cartons 1 or 101 thus enabling the choice of using the locking feature with the handle strap. Also, of course the relative orientation of the upper and lower trays might be different. Of course, the retaining function might be achieved entirely satisfactory simply by gluing the uppermost tray to the wrapper and it should be noted that in this example, gussets are not provided for the articles in the uppermost tier, however, such gussets might equally well be included. In any event, a wrapper of the type described with reference to FIG. 5 can be used in a single tray arrangement and/or with other forms of trays.

Figure 9:
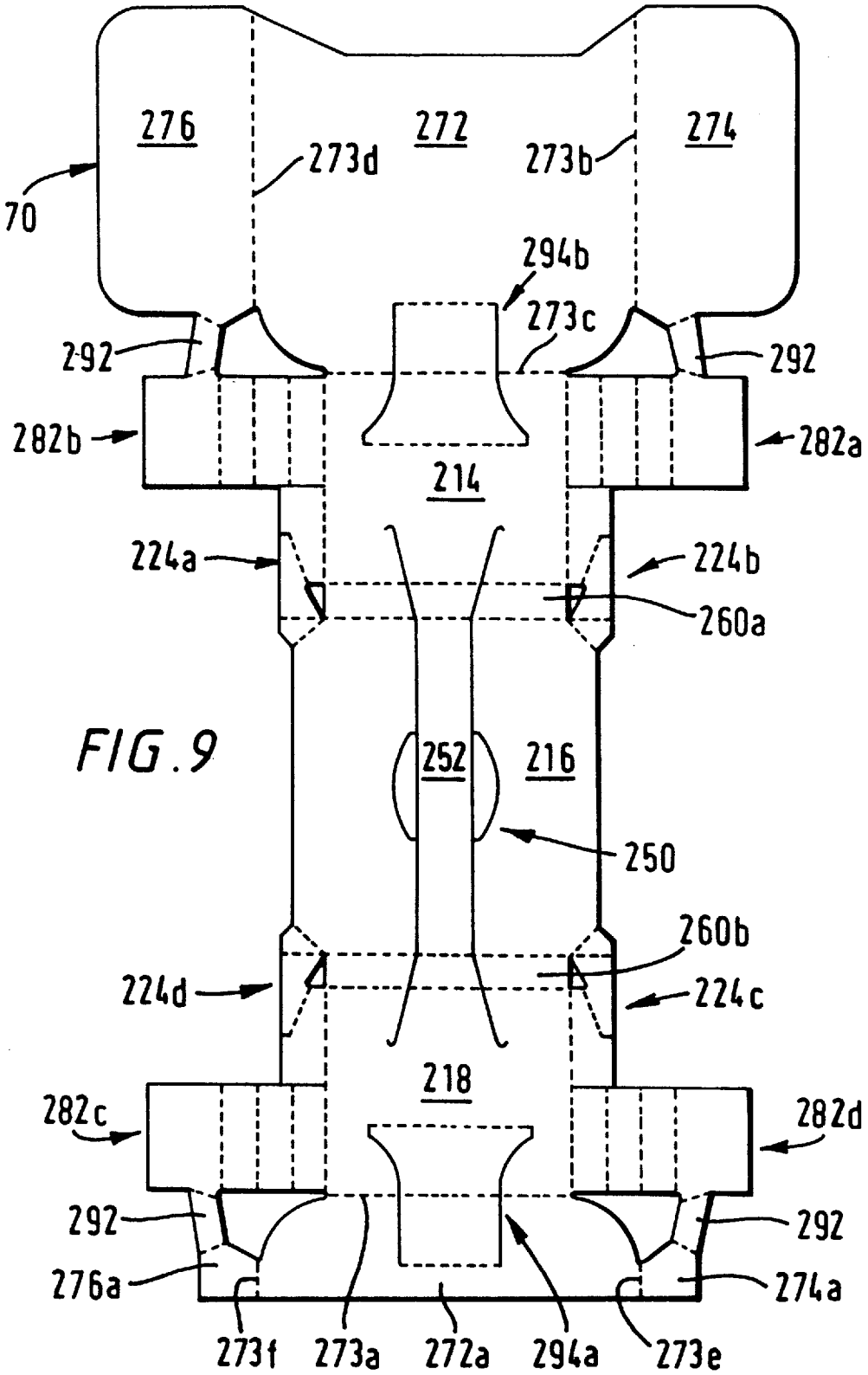
FIG. 9 is a plan blank for forming a carton according to a third embodiment of the invention.
Figure 10:
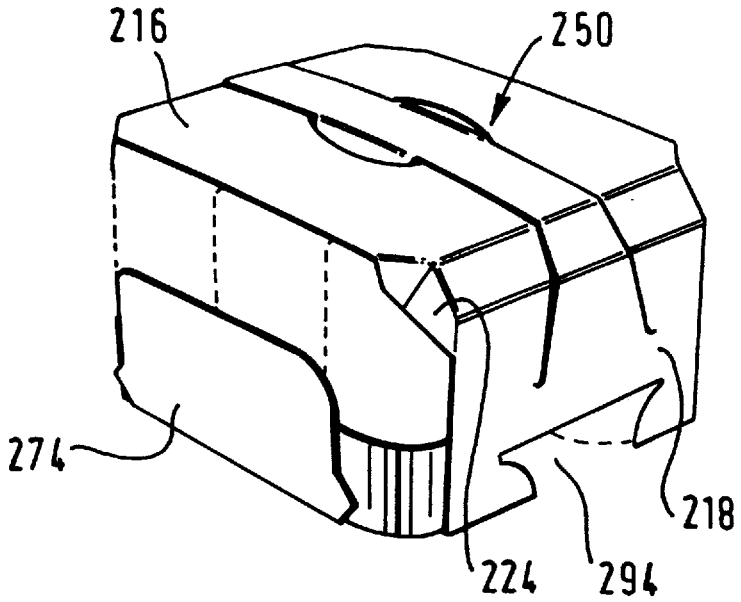
FIG. 10 is a perspective view of a carton formed from the blank shown in FIG. 9.

A third embodiment of the invention can be seen with reference to FIGS. 9 and 10 in which the handle and keel structure described herein is used in a single tier carton. In this embodiment portions corresponding to portions described herein for the first and/or second embodiments are given similar reference numerals but with the leading digit 2. Top panel 216 is connected to shoulder panels 260*a* and 260*b*, which are in turn connected to side panels 214 and 218 respectively. Side panel 214 is connected along its lower edge to base panel 272. Base panel 272 has a pair of end flaps 274 and 276 connected at its edges along fold lines 273*b* and 273*d*.

Corner arrangements 282*a* and 282*b* similar to those described herein for the trays are provided, with gusset panel 292 connecting the corner arrangements to end flaps 274 and 276. Also, gussets 224*a* and 224*b* are connected to the upper side edges of side panel 214 and top panel 216.

Side panel 218 is connected at its lower edge to partial base panel 272*a*. Partial end flaps 274*a* and 276*a* are connected along fold lines 273*e* and 273*f* respectively to partial base panel 272*a*.

Corner arrangements 282*c* and 282*d* are provided at the lower side edges of side panel 218, with gussets 292 connecting partial end flaps 274*a* and 276*a*. Gussets 224*c* and 224*d* connect between side panel 218 and top panel 216.

Handle structure 250 similar to that shown in FIG. 5 is provided in panels 214, 216, 218, 260*a* and 260*b*. Keels

294*a* and 294*b* are disposed in side panel 218 and partial base panel 272*a*, and in side panel 214 and base panel 272, respectively.

In use, the carton may be formed into a tube by gluing base panel 272 to partial base panel 272*a*. Keels 294*a* and 294*b* are put into a set-up condition, and articles are loaded into the tube from each of the open ends. Keels 294*a* and 294*b* cause the articles to be positioned in the proper nested arrangement, whereby a void is created into which the lower handle portions may move during use.

After loading, the corner arrangements 282*a*, 282*b*, 282*c* and 282*d* are folded in and end flaps 274 and 276 are folded up and glued to the corner arrangements to close the carton. The carton then appears as shown in FIG. 10.

Figure 12:
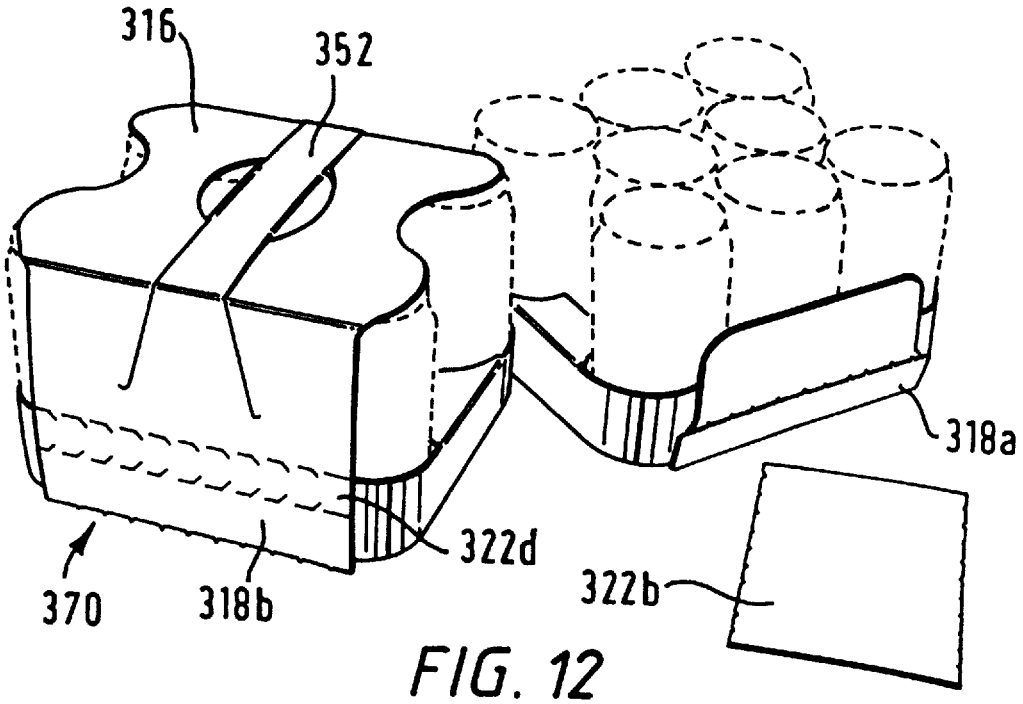
FIG. 12 is a perspective view of a carton comprising the wrapper shown in FIG. 11 and the tray shown in FIG. 2.
Figure 11:
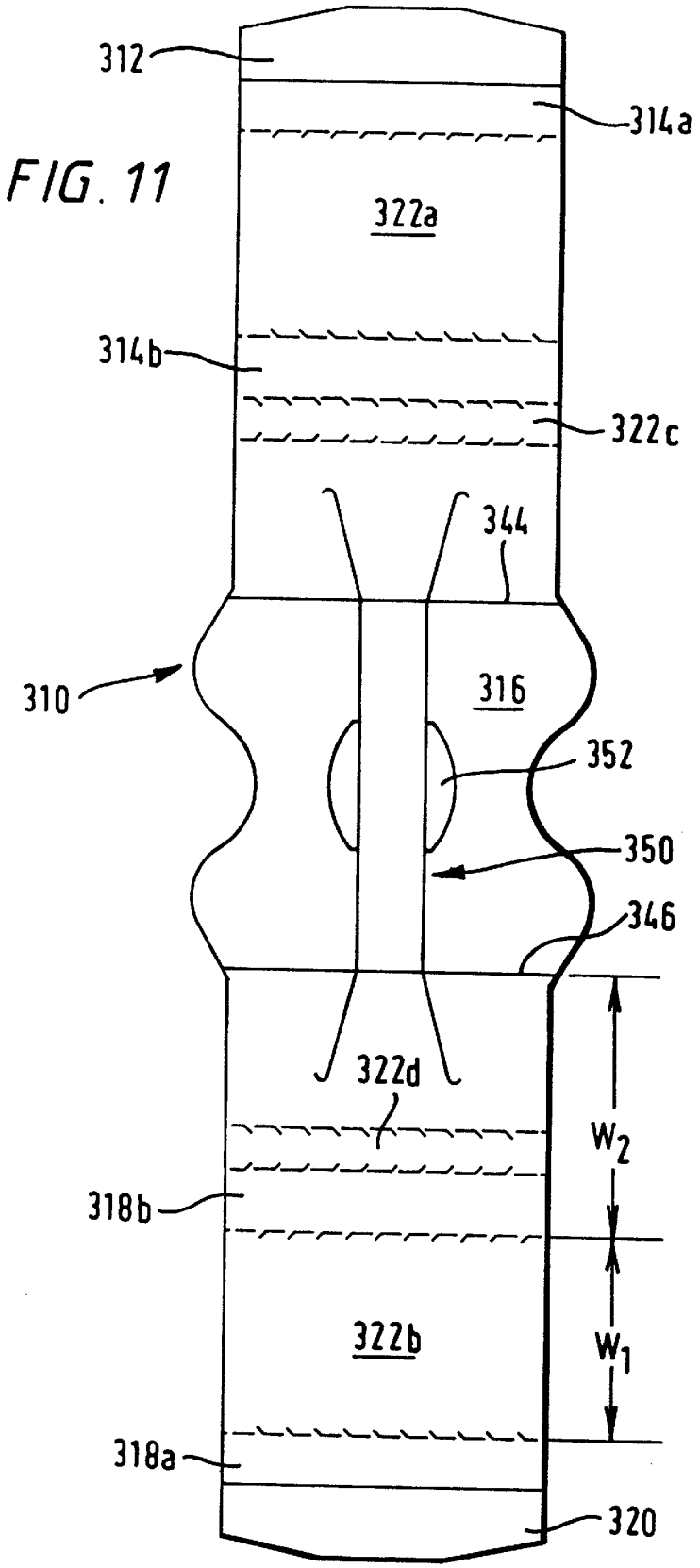
FIG. 11 is a plan view of a blank for forming a third wrapper according to the invention.

A fourth embodiment of a carton 310 according to the invention is shown in FIGS. 11 and 12. In this example, features which are similar to those in the earlier embodiments are labelled using the same two figure reference number prefixed with the digit 3. Thus, end panels 312 and 320, side panels 314 and 318, and upper panel 316 are provided. In this example, however, the side panels are divided by a lowermost tear feature 322*a* and 322*b* in side walls 314 and 318 respectively. This thereby provides a lowermost side wall portions 314*a* and 318*a* respectively which are hingably attached to the end panel 312 and 320 respectively. The tear features 322*a* and 322*b* can be relatively wide at W1 and preferably the distance W2, from the uppermost tear perforations of the lowermost tear portions (ie. 322*a* and 322*b*) to the fold lines 344 and 346 between the tops of the side panels and the upper panel, is substantially equal to the height of the articles to be retained. Thus, once the tear strips 322*a* and 322*b* are removed, an enclosed uppermost tray 370*a* as shown in FIG. 11 is retained. Preferably, intermediate side panel portion 314*b* and 318*b* are provided which can be attached to associated sides of the uppermost tray thereby to retain this tipper position of the wrapper to the uppermost tray once the lowermost tear strips 322*a* and 322*b* have been removed. A further tear strip 322*c* and 322*d* is provided in each of the side panels to enable removal of the rest of the wrapper from the uppermost tray. Of course, only one tear feature might be provided, for example feature 322*d* might be omitted since by tear strip 322*c* access can be gained to the uppermost tray 370*a*.

By attaching the wrapper for example by gluing at strips 314*b* and 318*b* to the uppermost tray, this tray can be removed as an intact unit as shown in FIG. 12. Of course, the trays might again be orientated in the manner described in relation to the embodiment described with reference to FIGS. 5 to 8 thereby to enable use of the handle to cooperate with the articles in the upper tray to retain the tray. Of course, the retaining function might be achieved entirely satisfactory simply by gluing the uppermost tray to the wrapper and it will be seen that in this example, gussets are not provided for the articles in the uppermost tier, however, such gussets might equally well be included.

We claim:

1. A carton for packaging a plurality of primary containers arranged in at least three lateral rows, a centre of said rows having fewer containers than adjacent ones of said rows comprising:

a support panel (72) upon which said containers are to be placed;

a top panel (16);

first and second side walls (14, 17) connected to said top panel (16);

means (24) for retaining said support panel (72) in a position with respect to said side panels (14, 18);

means (94) between said support panel (72) and at least one of said side walls (14, 18) and extending inwardly of said package for retaining said centre row of said containers (A) in an inwardly offset condition with respect to said adjacent rows of said containers.

2. A carton according to claim 1 further comprising a handle (50) formed at least partially from said top panel (16) and said first and second side panels (14, 18) and which, during use, protrudes partially into said carton adjacent to said centre row.

3. A carton as defined in claim 1 or claim 2 further comprises a bottom (12, 20) panel connected between said first and second side walls (14, 18) upon which a second layer of primary containers are to be placed, said support panel (72) being spaced from said bottom panel (12, 20) by a distance substantially equal to the height of the primary containers.

4. A carton as defined in any of the preceding claims wherein said support panel (72) forms a portion of a tray (70) for retaining the primary containers placed thereon, said means (24) for retaining said support panel (72) in position including means for fixing said tray (70) with respect to said top panel (16) and first and second side walls (14, 18).

5. A carton as defined in claim 4, wherein said fixing means includes retention gussets (32, 36) connected between said top panel (16) and said first and second side walls (14, 18) for retention of said containers placed within said tray (70), whereby said tray (70) is fixed in relative position.

6. A carton as defined in any of the preceding claims, wherein said centre row retaining means (94) includes a first panel (96) hingedly connected to said support panel (72) and a second panel (95) hingedly connected between said first panel (96) and a side wall (78) of said tray, said first and second panels (96, 95) being disposed for positioning between endmost containers of said centre row and said adjacent rows.

7. A carton as defined in any of the preceding claims wherein said support panel (72) may be connected to said first panel and side walls (14, 18) and forms a bottom wall for said carton.

8. A carton accommodating a plurality of primary containers arranged in an least three lateral rows, a centre of said rows having fewer containers than adjacent ones of said rows, comprising:

a support panel (72) upon which said containers are to be placed;

a top panel (116);

first and second side walls (114, 118) connected to said top panel (116);

means (124) for retaining said support panel (72) in a position with respect to said side panels (114, 118);

means (94) between said support panel (72) and at least one of said side walls (14, 18) and extending inwardly of said package for retaining said centre row of said containers (A) in an inwardly offset condition with respect to said adjacent rows of said containers and a handle (150) formed at least partially from said top panel (116) and said first and second side panels (114, 118) and which, during use, protrudes partially into said carton adjacent to said centre row.

9. A tray (70) for carrying a plurality of articles comprising a base panel (72) and upwardly projecting side panels (74, 76, 78, 80), the tray (70) being adapted to accommodate at least three adjacent rows of articles (A) wherein the central row has one less article (A) than the outer rows and wherein two adjacent rows are longitudinally displaced from one another to provide a closely packed formation, the tray (70) comprising means (94) which projects inwardly into the tray (70) to prevent movement of articles within the tray characterised in that said inwardly projecting means (94) is provided at each end of said central row to restrict movement of articles in said central row, said inwardly projecting means (94) comprising a lateral panel (95) which is hinged to and projects inwardly from a tray side wall panel (78, 80) and a lower panel (96) which is hinged to and projects upwardly from the base panel (72), said lower and lateral panels (95, 96) being hingably connected to one another.

10. A carton blank (10) for forming a tray (70) for carrying a plurality of articles (A) which blank (10) comprises a base panel (72; 272), side panels (74, 76, 78, 80; 274, 276, 282) hinged thereto, the tray when formed being adapted to accommodate at least three adjacent rows of articles wherein the central row has one less article than the outer rows and wherein two adjacent rows are longitudinally displaced from one another to provide a closely packed formation, the blank (10) further comprising means (94) which are adapted to project inwardly into the tray (70) to prevent movement of articles within the tray (70) when in use characterised in that said means (94) for projecting inwardly comprises a lateral panel (75) which is hinged to and struck from a tray side wall panel (78, 80) and a lower panel (96) which is hinged to and struck from the base panel (72; 272) said lower and lateral panels (95, 96) being hingably connected to one another.

11. A carton blank according to claim 10 wherein said base panel comprises a first panel part (272) and a second panel part **(272*a*) hinged together by a series of panels adapted to provide a top (216) for the tray and a pair of opposed side walls (214, 218) each of which is hinged to said top (216) and to said base (272) and wherein each of said side walls (214, 218)** incorporates one of said lateral panels.

12. A carton blank wrapper for coupling together a pair of trays of the type as claimed in claim 10 in which the trays **(70*a*, 70*b*) are disposed one atop another to create a stack, said wrapper comprising a top panel (16) for location upon the top of the articles in the uppermost tray (70*a*), a pair of side wall panels (14, 18) hinged to opposed edges of said top panel (11) and flanking opposed sides of said stack and a base panel (12, 20) hinged to each of said side wall panels (14, 18) and secured to lower portions (74, 76, 78, 80) of the lowermost tray (70*b*) and wherein said wrapper side wall panels (14, 18) and/or top panel (16) includes restraining means (24) for co-operation with articles of the uppermost tray (70*a*) in said stack to inhibit movement of the uppermost tray (70*a*) relative to the next adjacent tray (70*b*)**.

* * * * *